US007325803B1

(12) United States Patent
Miranda

(10) Patent No.: US 7,325,803 B1
(45) Date of Patent: Feb. 5, 2008

(54) SOCCER STRATEGY BOARD GAME

(76) Inventor: Allen Batres Miranda, 126 Porter St., San Francisco, CA (US) 94110

( * ) Notice: Subject to any disclaimer, the term of this patent is extended or adjusted under 35 U.S.C. 154(b) by 0 days.

(21) Appl. No.: 11/491,857

(22) Filed: Jul. 24, 2006

(51) Int. Cl.
*A63F 7/06* (2006.01)

(52) U.S. Cl. ..... 273/108.5; 273/108.41

(58) Field of Classification Search ..... 273/108.1, 273/108.5, 108.41, 239, 247, 242, 277, 288, 273/289, 290, 282.1, 259
See application file for complete search history.

(56) References Cited

U.S. PATENT DOCUMENTS

| | | | | |
|---|---|---|---|---|
| 2,716,028 A | | 8/1955 | Yaeger | |
| 2,964,320 A | | 12/1960 | Lebrun | |
| 3,091,459 A | | 5/1963 | Lindman | |
| 3,940,135 A | | 2/1976 | Cohen | |
| 3,976,296 A | | 8/1976 | Smith | |
| 4,834,371 A | | 5/1989 | Hay et al. | |
| 5,016,878 A | | 5/1991 | Hay et al. | |
| 5,092,595 A | * | 3/1992 | Daravina | 273/108.5 |
| 5,423,537 A | * | 6/1995 | Santana | 273/108.5 |
| 5,431,397 A | * | 7/1995 | Eckel et al. | 273/108.1 |
| 6,189,885 B1 | | 2/2001 | Hamot | |
| 6,450,497 B1 | | 9/2002 | Bialler et al. | |
| 6,561,511 B1 | | 5/2003 | Vaysberg et al. | |
| 6,682,070 B1 | | 1/2004 | Rosenfeld et al. | |
| 7,147,225 B2 | * | 12/2006 | Navarro | 273/242 |

FOREIGN PATENT DOCUMENTS

| | | |
|---|---|---|
| CH | 672993 | 1/1990 |
| DE | 10104207 | 10/2002 |
| GB | 761.345 | 10/1953 |
| GB | 1.318.744 | 5/1973 |
| RU | 2206360 | 6/2003 |

* cited by examiner

*Primary Examiner*—Nini F. Legesse
(74) *Attorney, Agent, or Firm*—Michael I. Kroll

(57) ABSTRACT

A soccer board game having a ferromagnetic surface and games pieces incorporating magnets to maintain the selective positioning of the game pieces during a play turn. The game pieces have a contoured magnetic base depending on the positioned played. The top surface of the board has a graphic image of a soccer field and a raised perimeter lip defining the field of play. Opposing goals are provided along with a game ball and sticks. During play the defensive player positions his pieces to block goals while the offensive player uses their game stick to strike the ball in an attempt at scoring a goal.

11 Claims, 11 Drawing Sheets

SOCCER STRATEGY BOARD GAME

BACKGROUND OF THE INVENTION

1. Field of the Invention

The present invention relates generally to board games and, more specifically, to a soccer board game having a ferromagnetic surface and games pieces incorporating magnets to maintain the selective positioning of the game pieces during a play turn. The requisite number of game pieces are selectively positioned by each player with the game ball positioned on the center spot whereupon one player using their designated game stick hits the ball in an attempt to score a goal. Successive turns are played by the defensive player positioning pieces to block goals while the offensive player uses his stick to strike the ball in an attempt at scoring a goal. Goals are scored by a player hitting the ball into the opposing player's goal.

The top surface of the board has a graphic image of a soccer field and marked locations for center spot and penalty spots with the game board having a raised perimeter lip defining the field of play.

In addition, the players and contour of the magnetic base for the game pieces is varied depending on the position played, such as the goalie having a cavity between the legs to stop the ball. Other player's can have a long stance as if running with a substantially linear base while others have a wider front edge for blocking the ball. Strategic placement of the pieces by the defensive player and offensive player mimics a chess-like game with the magnetic bases of the player's inhibiting movement if struck by the game ball.

2. Description of the Prior Art

There are other board devices designed for games. Typical of these is U.S. Pat. No. 2,716,028 issued to Yaeger on Aug. 23, 1955.

Another patent was issued to Lebrun on Dec. 13, 1960 as U.S. Pat. No. 2,964,320. Yet another U.S. Pat. No. 3,091,459 was issued to Lindman on May 28, 1963 and still yet another was issued on Feb. 24, 1976 to Cohen as U.S. Pat. No. 3,940,135.

Another patent was issued to Smith on Aug. 24, 1976 as U.S. Pat. No. 3,976,296. Yet another U.S. Pat. No. 4,834,371 was issued to Hay, et al. on May 30, 1989. Another was issued to Hay, et al. on May 21, 1991 as U.S. Pat. No. 5,016,878 and still yet another was issued on Feb. 20, 2001 to Hamot as U.S. Pat. No. 6,189,885.

Another patent was issued to Bialler, et al. on Sep. 17, 2002 as U.S. Pat. No. 6,450,497. Yet another U.S. Pat. No. 6,561,511 was issued to Vaysberg, et al. on May 13, 2003. Another was issued to Rosenfeld, et al. on Jan. 27, 2004 as U.S. Pat. No. 6,682,070 and still yet another was issued on Nov. 14, 1956 to Soccerette Limited as U.K. Patent No. GB761,345.

Another patent was issued to Konsumex Kulkereskedelmi Vallalat on May 31, 1973 as U.K. Patent No. GB1318744. Yet another Switzerland Patent No. CH672993 was issued to Ehrat on Jan. 31, 1990. Another was issued to Vinogradov on Jun. 30, 2003 as Russian Patent No. RU2206360.

U.S. Pat. No. 2,716,028

Inventor: Bernard W. Yaeger

Issued: Aug. 23, 1955

In a game apparatus, a supporting structure having a top part defining a playing surface, a plurality of player simulating units mounted for movement over said playing surface and each including a base portion capable of being magnetically attracted and each having a recessed-portion in a part thereof, a playing piece mounted for movement on said playing surface capable of being engaged in the recess portion of each of said player simulating units for movement therewith over the playing surface, a plurality of manually operated, manipulating devices each including a magnet, means forming a part of the supporting structure slidably and turnably supporting the manipulating devices beneath said top part in positions whereby the magnetically attractable base portions are connected by magnetic attraction to the magnets of the manipulating devices so that said player simulating units are selectively movable on the playing surface by movement of said manipulating devices.

U.S. Pat. No. 2,964,320

Inventor: Robert Lebrun

Issued: Dec. 13, 1960

A toy game comprising a field, a plurality of players freely movable on said field, normally engaged braking means for each player, means for cyclically releasing the braking means of one player at a time for a short interval, and means for producing during each said interval an impulse on said field substantially in its own plane, selecting means peculiar to each player selecting the direction of said impulse, said field comprising resilient means to produce a return movement of said field which is slower than said impulse movement, said selecting means being synchronized with said brake releasing means, so that during each brake releasing interval, said field is impulsed in a direction selected by one of said selecting means peculiar to one player.

U.S. Pat. No. 3,091,459

Inventor: George E. Lindman

Issued: May 28, 1963

In a game played with magnetized players adapted to be slideably moved over a game board under influence of operating magnets moved beneath said game board, the combination comprising: a plurality of magnetized player units visually delineated into first and second opposing teams of players; said player units each comprising a bar magnet provided with a flat base portion for supporting said bar magnet in upright position for slideable movement along the surface of a game board; the north and south poles of the bar magnets comprising the players of said first team arranged similarly and with the north pole of each situated adjacent the base portion of the player, whereby the players within said first team are magnetically repellent to each other in upright position; the north and south poles of the bar magnets comprising the players of said second team arranged similarly and with the south pole of each situated adjacent the base portion of the player, whereby the players within said second team are magnetically repellent to each other and magnetically attractive to the players of said first team in upright position; and at least one operating magnet provided to manipulate each team from the underside of the game board, said operating magnets for opposite teams disposed with their north and south poles in vertically opposite polarity so that each said operating magnet is magnetically attractive to only the players of the team it is respectively adapted to manipulate.

U.S. Pat. No. 3,940,135

Inventor: Samuel W. Cohen

Issued: Feb. 24, 1976

A hockey game having a game board with a pair of spaced apart transparent plates and at least one magnetic actuator moving on the outer surface of a plate. Team members which can be attracted by the magnetic actuator are disposed in the space between the plates to slide on the upper surface of the bottom plate as an actuator is moved to hit and propel a puck. The team members are of three-dimensional construction to have an impact surface to the puck at any orientation. In the preferred embodiment, an area of the top plate is recessed and certain of the team members are of increased height confining their movement by an actuator in the area of the board which is not recessed.

U.S. Pat. No. 3,976,296

Inventor: Robert A. Smith

Issued: Aug. 24, 1976

A game apparatus comprising a playing surface with a plurality of playing members on the surface. A ball member is adapted to move over the playing surface among the playing members with a magnetic element within the ball member. A rotatable surface located below the playing surface carries a plurality of second magnetic elements which exert magnetic forces on the magnetic element within the ball. The movement of the rotatable surface randomly positions the ball member on the playing surface and among the playing members.

U.S. Pat. No. 4,834,371

Inventor: Eric Hay, et al.

Issued: May 30, 1989

In a game having magnetically operable pieces (3) there are below a game board (2) several operating magnets (4) for operating the pieces, the operating magnets being separated by intermediate layers (7) that are parallel to the game board. The intermediate layers are thin and easily flexible and rest on top of each other, the game board resting on top of the top intermediate layer. A specially designed piece is included in the game.

U.S. Pat. No. 5,016,878

Inventor: Eric Hay, et al.

Issued: May 21, 1991

In a game having magnetically operable pieces (3) there are below a game board (2) several operating devices (4) for operating the pieces, these operating devices being separated by intermediate layers (7) that are parallel to the game board. The intermediate layers are thin and easily flexible and rest on top of each other, the game board resting on top of the top intermediate layer. A specially designed piece is included in the game, intended for contact with the game board. This piece has two supports (9, 10) e.g. the feet of a human figure. One (9) of the supports rests on and carries a magnet (8) that can be moved by a cooperating magnet (13) beneath the game board. The other support (10) has a supporting surface (11) of friction material.

U.S. Pat. No. 6,189,885

Inventor: Thierry Hamot

Issued: Feb. 20, 2001

A game, of the table soccer type, comprises a playing surface, pieces imitating players and a ball simulating a football. It has, along the table, on each of two opposite sides, a series of control levers, each lever corresponding to the movement of a player. Each player is connected to a carriage comprising two drive motors, each of which drives a wheel, and an electronic receiving unit. Each control lever is attached to a transmitter unit in order to control selectively the power supply of one or other of the motors in one direction or the other.

U.S. Pat. No. 6,450,497

Inventor: Valeri Villievich Bialler, et al.

Issued: Sep. 17, 2002

A magnetic table game is disclosed wherein gaming pieces are movably mounted to a substantially non-magnetic playing surface of a game by a magnetic coupling device. The coupling device comprises a base mounted to the gaming piece, the base having a housing, a first and second magnet and a first support element positioned between the first and second magnets and further positioned to support the base on the surface. The base is held on surface by a magnetic coupling positioned on the opposite side of the surface. The magnetic coupling has a housing, a first and second magnet and a second support element positioned between the first and second magnets of the magnetic coupling and further positioned to support the base on the surface. The housings and the support members of the base and magnetic coupling are configured to position the magnets of the base in close proximity to the magnets of the magnetic coupling when the base and magnetic coupling are mounted to each other on opposite sides of the surface. The support members are made of a low friction material and are rotatably mounted to their respective housings by bearings. The gaming pieces are manipulated by moving the magnetic couplings via long lever arms which are operatively coupled to the magnetic couplings by gear drives. The gear drives convert the torsion of the lever arms into the rotation of the magnetic couplings, which in turn cause a corresponding rotation of the corresponding player piece.

U.S. Pat. No. 6,561,511

Inventor: Tsaliy I. Vaysberg

Issued: May 13, 2003

A table game includes a generally planar panel having a top surface including a playing field. First and second playing pieces are slidably positioned on the playing field. First and second control members are located below the panel with the first control member being magnetically coupled with only the first playing piece and with the second control member being magnetically coupled with only the second playing piece The first and the second control members are capable of moving the first and the second playing pieces respectively to substantially any location on the playing field without mutual interference between the first and the second control members.

U.S. Pat. No. 6,682,070

Inventor: Gerald Rosenfeld

Issued: Jan. 27, 2004

A game such as a tabletop hockey game that is comprised of a smooth, substantially planar playing surface defined by a raised border, having goal cavities at each end and suspended by a framing assembly over a base. Actuators located under the bottom of the playing surface are movable by control rods and by foot operated cable devices, said actuators include first coupling magnets. The game also has object propelling elements that are movable over the top of the playing surface, and propelled object blocking elements that move from side to side over the playing surface in front of the goal cavities, said elements include second coupling magnets. A game wherein the first and second magnets coupled through the playing surface so that movement of the actuators results in a corresponding movement of the object propelling and propelled object blocking elements to propel and block a playing object.

U.K. Patent Number GB761,345

Inventor: Soccerette Limited

Issued: Nov. 14, 1956

Apparatus for playing a table game comprises a board of non-magnetic material, two sets of counters slidable over the board, a handle for moving the counters of each set by manipulation of the handle under the board, a ball or the like moved over the board by propelling the counters against it by the handles, each counter and its co-operating handle including magnetic materials at least one of which is a permanent magnet and the magnetic materials in each counter of one set and its co-operating handle being arranged so that the magnetic lines of force set up between adjacent poles run through the board in the opposite direction from those set up between adjacent poles of the magnetic materials of each of the other set of counters and its co-operating handle. As shown, a board 20 of non-magnetic material is marked as a football, hockey or cricket pitch and has a frame 22 bored to receive goal post members 24, 25. The counters comprise plastic FIG. 29, each mounted on a base 30 to which is secured a plate 31 of magnetic material, and are manipulated by handles set at an acute angle to a pole face of, or pivoted to a wooden base 35 supporting, magnetic material 34. The game can be played with three players on each side each provided with a handle to propel the counters of one set. The counters and handles may all contain permanent magnets arranged as in FIG. 9, the counters A and handles A1 belonging to one team and counters B and handles B1 belonging to the other team, or the magnetic material in one set of counters may be permanent magnets, the co-operating handles including a piece of soft iron in which magnetic polarity is induced, the other set of counters each having a piece of soft iron in the base and the co-operating handles having a permanent magnet.

U.K. Patent Number GB 1 318 744

Inventor: Konsumex Kulkereskedelmi Vallalat

Issued: May 31, 1973

A game simulating football, ice hockey, golf, cricket or hockey comprises a board made at least in part of magnetisable material, a projectile made of or containing a permanent magnet and player figures having manually actuable spring operated parts for displacing the projectile. A board for simulating soccer may be marked to scale with boundaries and include a non-magnetic insert covering each penalty area. The projectile may be a circular or polygonal disc or a hemisphere and may contain a permanent magnet offset from its centre of gravity to ensure a curved trajectory in play. In another embodiment the projectile includes two permanent magnets separated by a piece of non-magnetic material.

Switzerland Patent Number CH672993

Inventor: Kurt Ehrat

Issued: Jan. 31, 1990

The permanent-magnet game comprises one or more figures containing a magnet movable over a surface. A man, animal or vehicle is represented with a normal forwards travel direction, the magnetic axis being perpendicular to the surface. A hand-operated driving magnet with a similar axis is also movable over the surface. Virtually the entire weight of the figure is supported at a contact point with the surface at the centre of gravity. The magnet is in front of the latter in the travel direction. The figure is repelled by the driving magnet in this direction. USE—Can represent a mouse fleeing from a cat.

Russian Patent Number RU2206360

Inventor: Sergej Ivanovich Vinogradov

Issued: Jun. 20, 2003

FIELD: table games simulating ice hockey. SUBSTANCE: table hockey has playing board with playing field, board supporting device, couple of gates, puck, figures of field players, figures of goalkeepers, and operators' clubs, with all mentioned parts of table game being manufactured from non-magnetic material. Figures of players and goalkeepers have upper parts movable with respect to lower part and provided with body and shoulder members attached to body sides. Lower part has body with base equipped with front recess for catching and guiding puck and magnet secured in base. Operators' clubs are positioned under playing board and have basic part with handle and tip equipped with contact member and magnet. Tip on each operators' club is positioned substantially at regular angle with respect to longitudinal axis of pluck and provided with deviating roll made of resilient material and with supporting member fixed in tip base. Contact member is fixed on tip end. Deviating roll is mounted on tip between contact member and supporting member for rotation around tip axis. Contact member is equipped with vertical opening for receiving magnet. The given game is aimed at increasing dynamic cooperation of operators with one another through operators' clubs and figures of players during performing playing actions in any point of playing field. EFFECT: simplified construction and increased efficiency.

While these board games may be suitable for the purposes for which they were designed, they would not be as suitable for the purposes of the present invention, as hereinafter described.

SUMMARY OF THE PRESENT INVENTION

A primary object of the present invention is to provide a soccer board game that includes strategic planning in scoring goals.

Another object of the present invention is to provide a soccer board game that incorporates magnetism to secure the player's placement of game pieces.

Yet another object of the present invention is to provide a soccer board game having a rigid planar material forming a base with a ferromagnetic layer positioned thereover.

Still yet another object of the present invention is to provide a soccer board game having a top surface comprised of a fabric material with a graphic image thereon of a typical soccer field.

A further object of the present invention is to adhesively bond the board base, ferromagnetic layer and fabric layer together.

Another object of the present invention is to provide a soccer board game having an edge positioned lip defining the playing surface.

An additional object of the present invention is to provide board locations for center spot and penalty spot.

A further object of the present invention is to provide goal stands having magnetic elements positioned on the base to prevent movement during game play and additional serve as storage units for the game sticks and ball during non-play storage.

Another object of the present invention is to provide a non-ferromagnetic game ball and sticks for the defensive and offensive game players that are used in turn to hit the game ball.

Yet another object of the present invention is to provide a soccer board game having game pieces with the game pieces in various stances and variously contoured bases depending on their functional position, such as the goalie having a cavity between the legs to catch the ball.

Still yet another object of the present invention is to provide a soccer board game having instructions that includes positioning the pieces to prevent the other player from scoring a goal.

Additional objects of the present invention will appear as the description proceeds.

The present invention overcomes the shortcomings of the prior art by providing a soccer board game having a ferromagnetic surface and games pieces incorporating magnets to maintain the selective positioning of the game pieces during a play turn. The requisite number of game pieces are selectively positioned by each player with the game ball positioned on the center spot whereupon one player using their designated game stick hits the ball in an attempt to score a goal. Successive turns are played by the defensive player positioning pieces to block goals while the offensive player uses his stick to strike the ball in an attempt at scoring a goal. Goals are scored by a player hitting the ball into the opposing player's goal.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
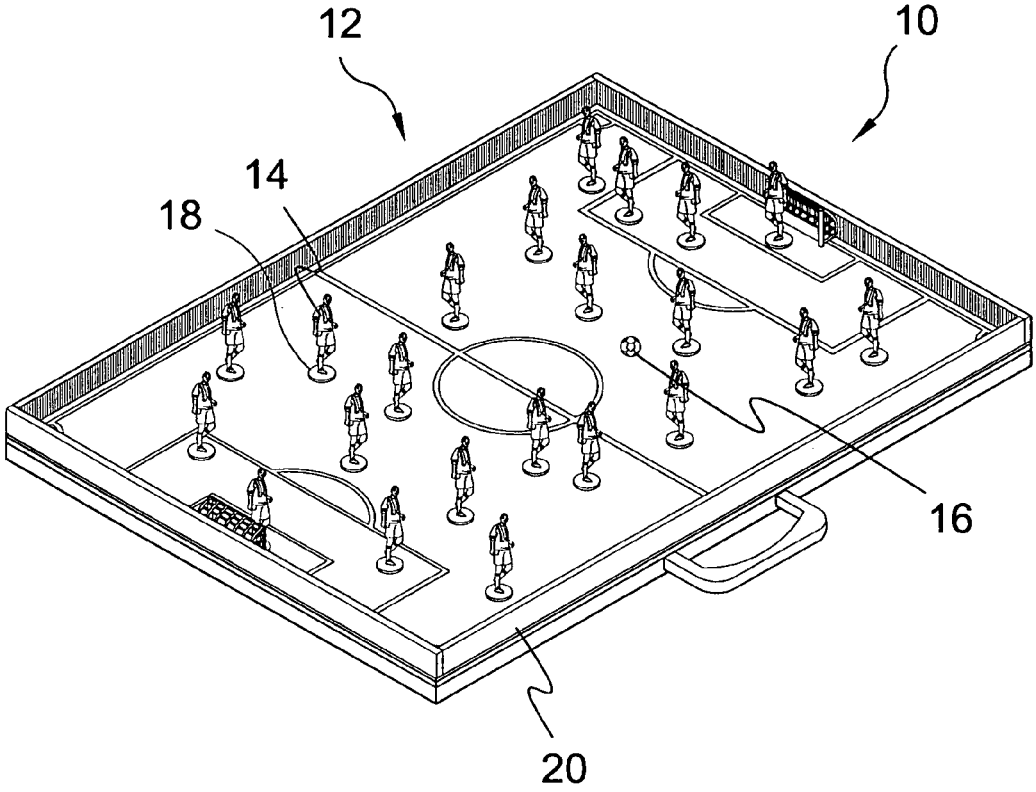
FIG. 1 is an illustrative view of the present invention.

Turning now descriptively to the drawings, in which similar reference characters denote similar elements throughout the several views, the figures illustrate the Strategic Soccer Board Game of the present invention. With regard to the reference numerals used, the following numbering is used throughout the various drawing figures.

10 Strategic Soccer Board Game of the present invention
12 game board
14 game piece
16 ball
18 magnetic base
20 confining wall
22 base assembly of 12
24 base plate
26 stainless steel sheet
28 felt sheet
30 goal
32 handle
34 adhesive
36 game ball spot
38 penalty spot
40 soccer field print
42 goal area
44 penalty line
46 penalty arc

48 midfield line
50 corner arc
52 penalty area
54 penalty arc
56 center circle
58 screw
60 stick
62 magnet
64 base of 14
66 user

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention is a strategy board game 10 comprising a game board 12 and plurality of game pieces 14 repositionable to a desired location during a turn of play with means for propelling a game ball 16 by a stick to score a goal. Magnetic bases 18 are provided for retaining positioning of placed game pieces 14 when impacted by the game ball 16 during play. A confinement wall 20 depends peripherally from the game board 12 to confine the game ball 16 therein. During play each player in turn attempts to score a goal using the at rest position of the game ball 16 from the previous player's turn as their starting point.

Figure 2:
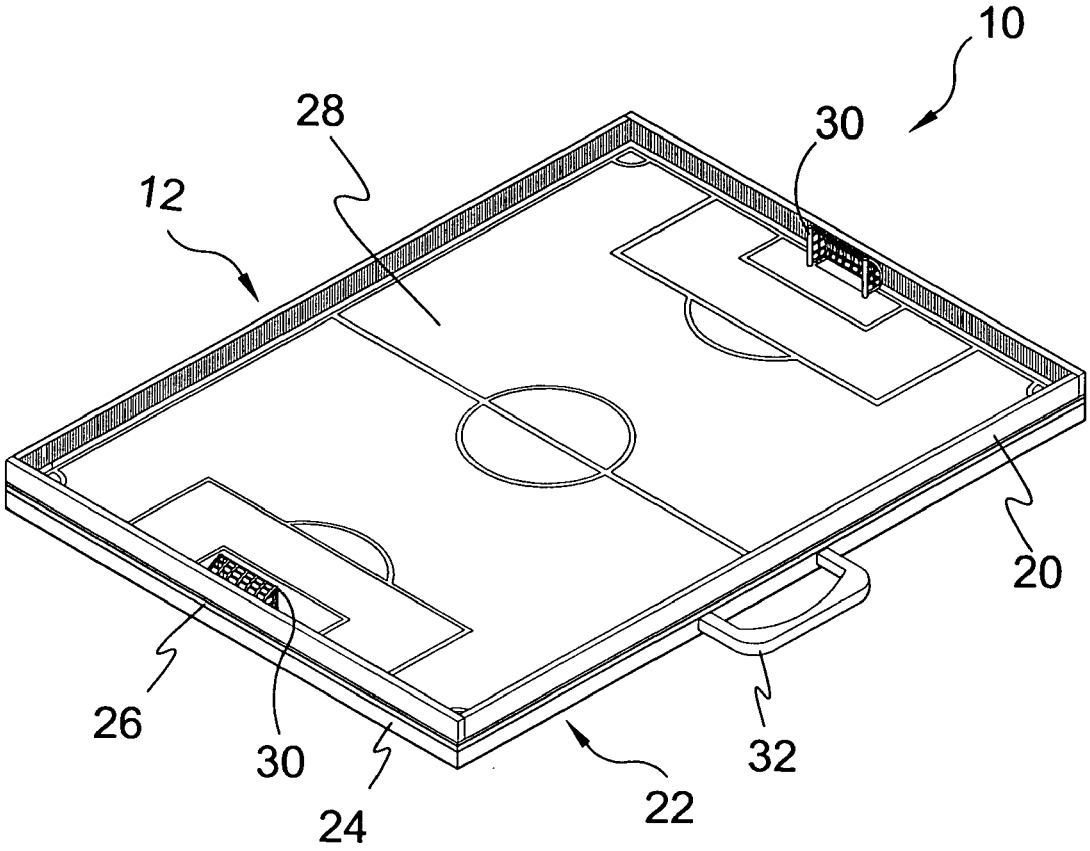
FIG. 2 is a perspective view of the game board of the present invention.

FIG. 2 is a perspective view of the game board 12 of the present invention 10. Shown is the game board 12 for a soccer strategy board game 10 comprising confining walls 20 fixedly attached to a layered base assembly 22 with one confining wall 20 having a handle 32 attached thereto. The base assembly 22 includes a base plate 24 having a stainless steel sheet 26 and a top felt sheet 28 mounted together by means of adhesive. The felt sheet 28 has a soccer field image impregnated thereon. Opposing goals 30 are disposed and the ends of the game board 12.

Figure 3:
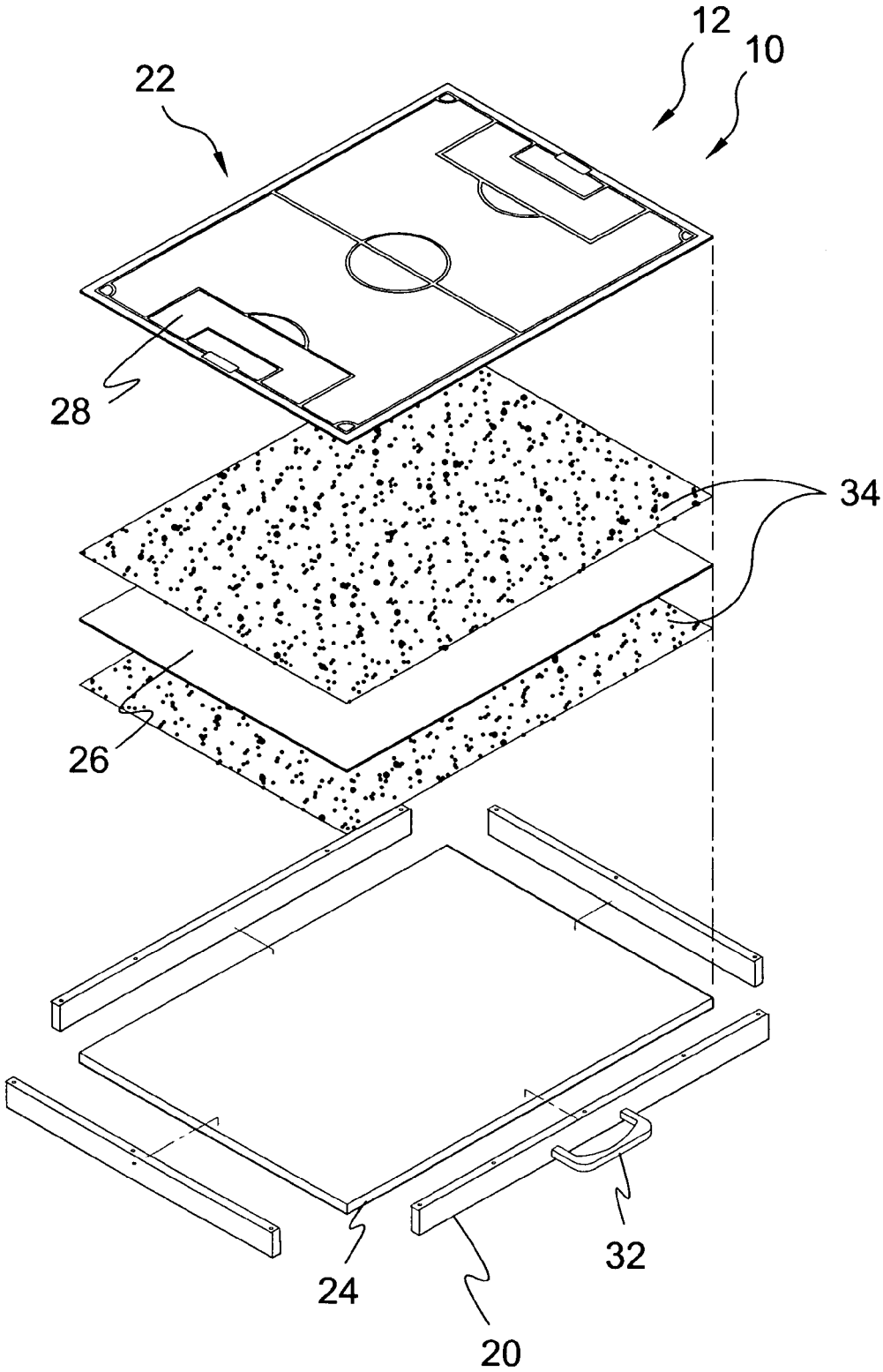
FIG. 3 is an exploded view of the game board of the present invention.

FIG. 3 is an exploded view of the game board of the present invention. Shown is an exploded view of the game board 12 for a soccer strategy board game 10 comprising confining walls 20 fixedly attached to a layered base assembly 22 with one confining wall 20 having a handle 32 attached thereto. The base assembly 22 includes a base plate 24 having a stainless steel sheet 26 and a top felt sheet 28 mounted together by means of adhesive 34. The felt sheet 28 has a soccer field image impregnated thereon.

Figure 4:
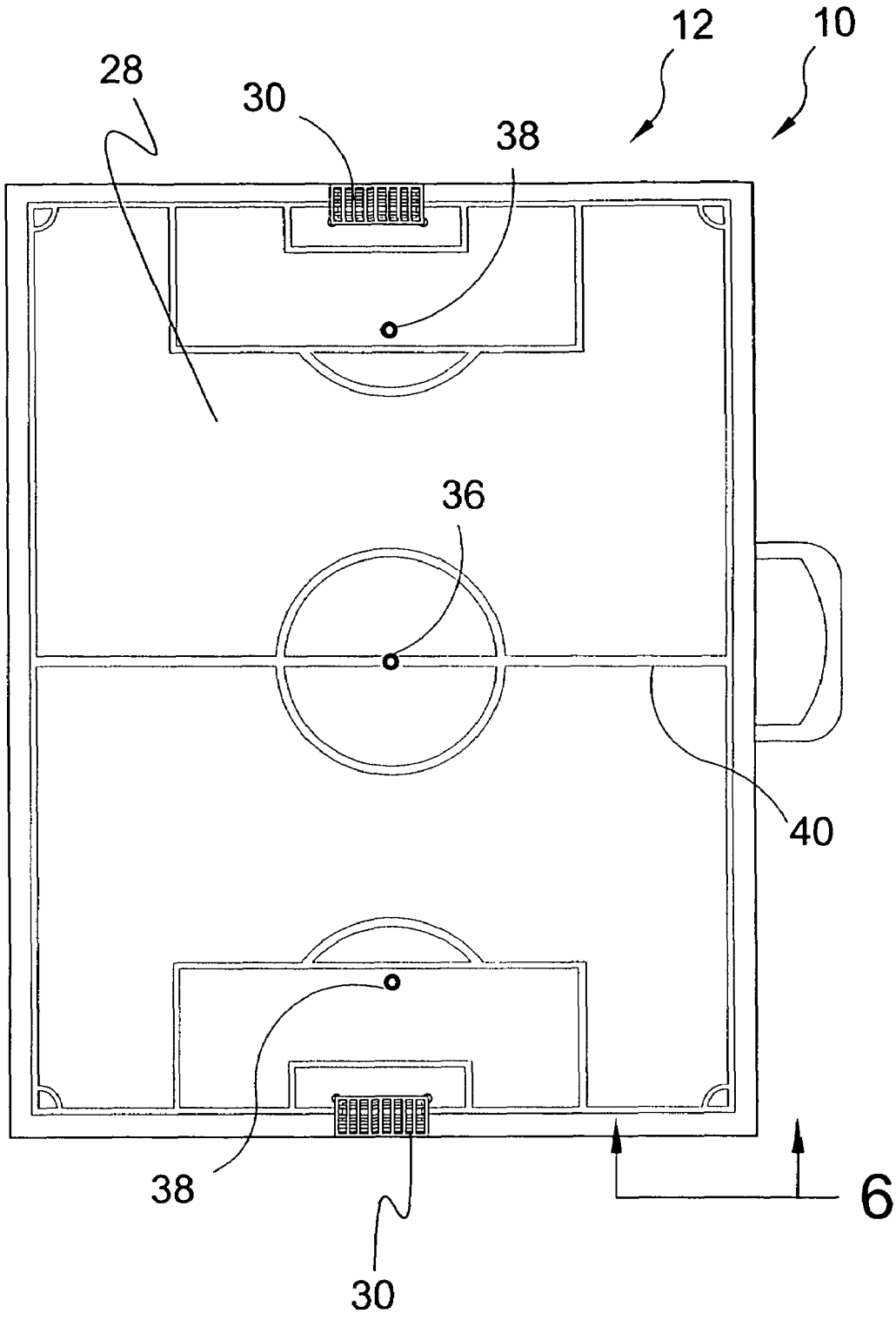
FIG. 4 is a top view of the game board of the present invention.

FIG. 4 is a top view of the game board 12 of the present invention 10. Shown is a top view of the game board 12 comprising a fabric top layer 28 having a soccer field image 40 portrayed thereon with a game ball spot 36 at center field and penalty spot 38 at each goal 30. Also shown are goal nets 30 positioned on opposing ends that have magnetic elements on the base to prevent displacement during play.

Figure 5:
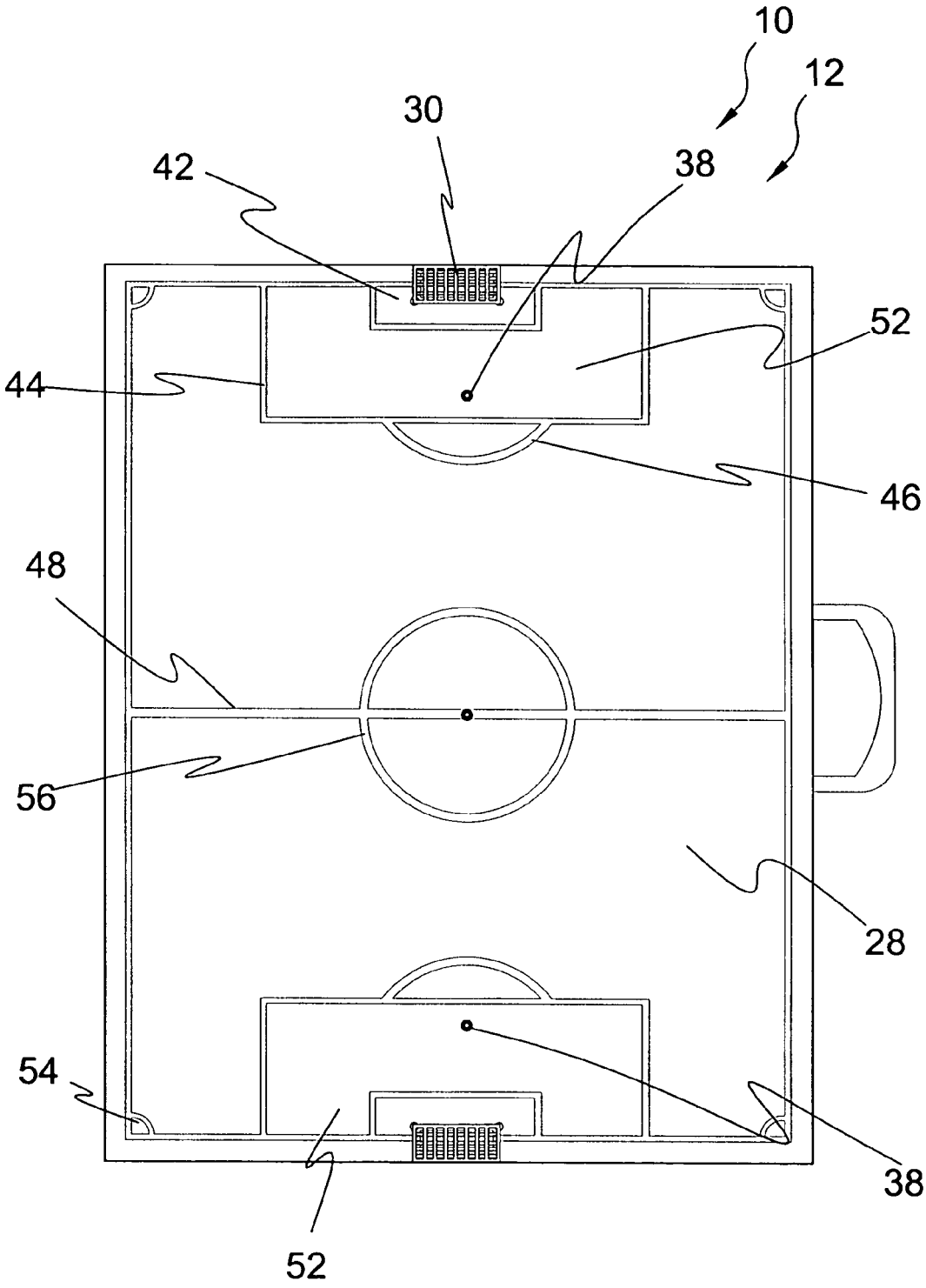
FIG. 5 is a top view of the game board of the present invention.

FIG. 5 is a top view of the game board 12 of the present invention 10. Shown is a top view of the game board 12 comprising a fabric top layer 28 having a soccer field image 40 portrayed thereon with a game ball spot 36 at center field and penalty spot 38 at each goal 30. Printed lines indicate the goal area 42, the penalty area 52, the penalty line 44, the midfield line 48, the center circle 56 and the corner arc 54. Also shown are goal nets 30 positioned on opposing ends that have magnetic elements on the base to prevent displacement during play.

Figure 6:
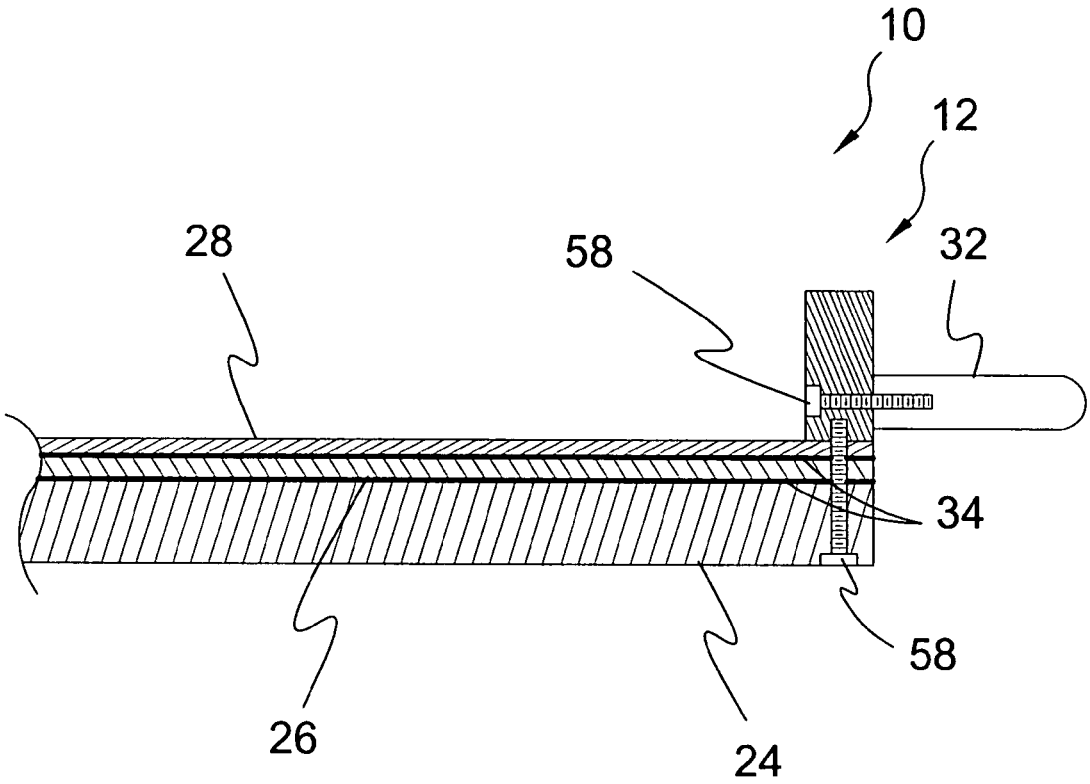
FIG. 6 is a sectional view of the game board of the present invention.

FIG. 6 is a sectional view of the game board 12 of the present invention 10 taken from FIG. 5 as indicated. Shown is the base assembly 22 with confining walls 20 attached thereto by a screw 58 with one confining wall 20 having a handle 32 attached thereto also by a screw 58. The base assembly 22 comprising a base plate 24 having a stainless steel sheet 26 and a top felt sheet 28 mounted together by means of adhesive layer 34 therebetween.

Figure 7:
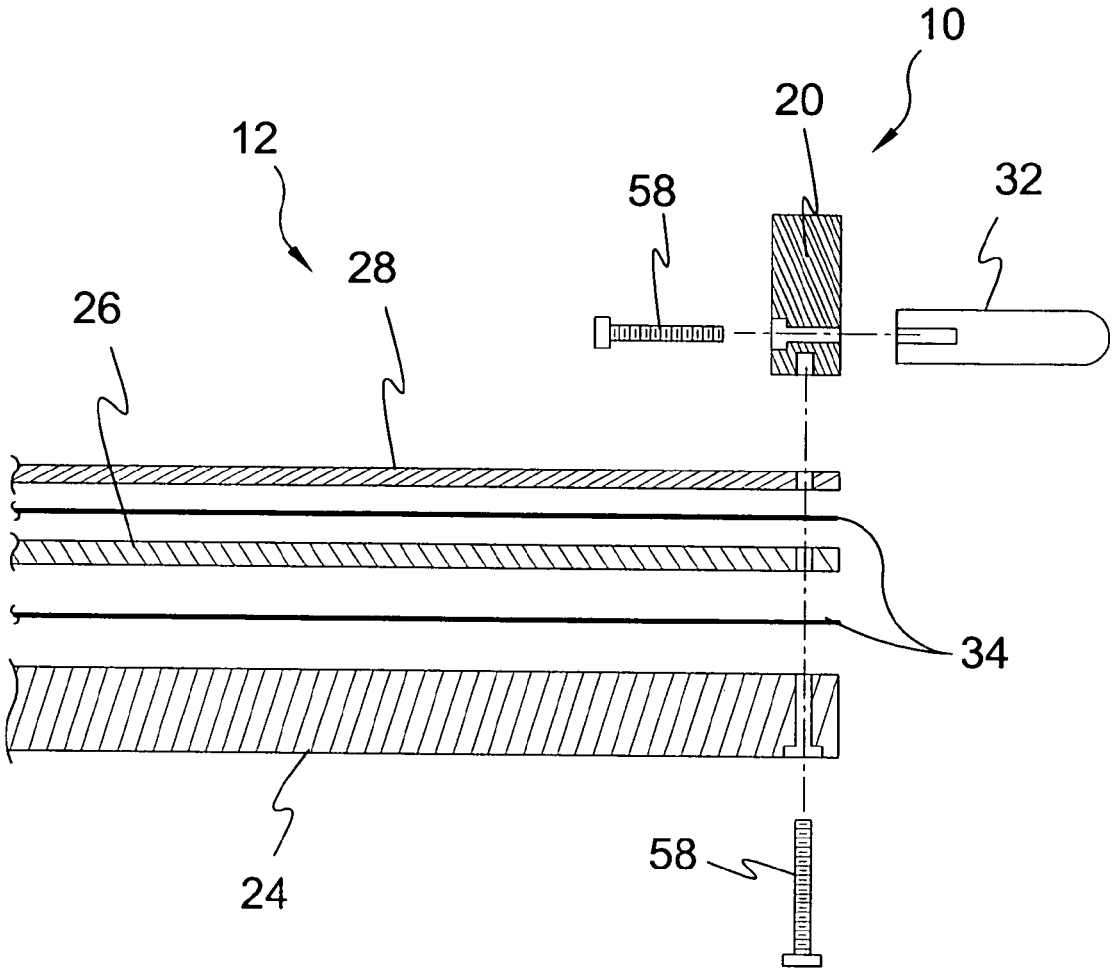
FIG. 7 is an exploded partial sectional view of the present invention.

FIG. 7 is an exploded partial sectional view of the present invention 10. Shown is the game board 12 comprising a felt top sheet 28 having a soccer field image impregnated onto its surface. Below the felt top sheet 28 is a sheet of stainless steel 26, allowing the magnetic base of a player piece to remain in a play position. Both layers are attached to a base plate 24 and utilize adhesive layers 34 for binding. A confining wall 20 surrounds the outer/upper peripheries, one confining wall 20 having a handle 32 attached thereto by a screw 58.

Figure 8:
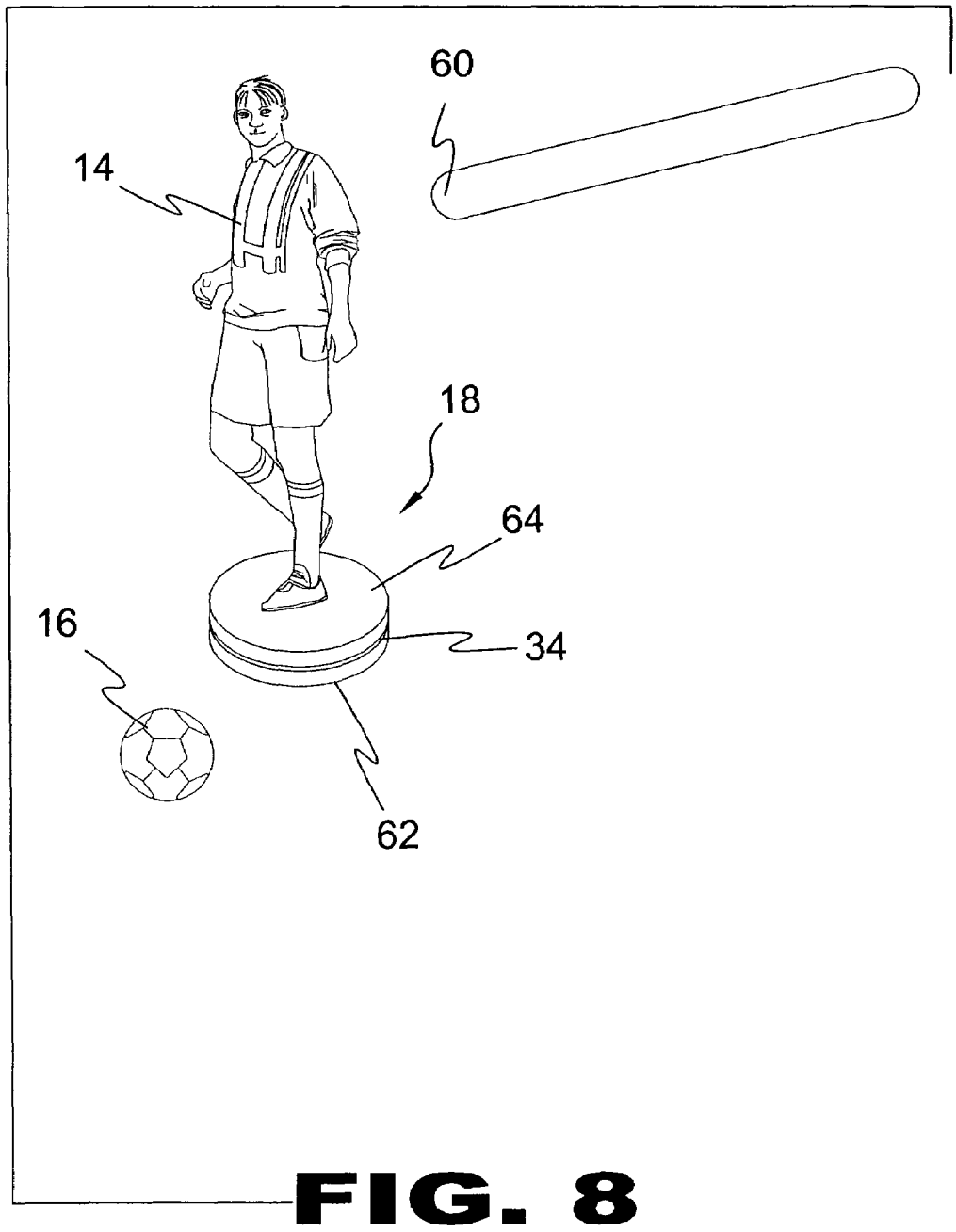
FIG. 8 is an illustrative view of typical play pieces of the present invention.

FIG. 8 is an illustrative view of typical play pieces of the present invention. Shown are the stick 60, ball 16 and player game piece 14 used during game play The size and shape of game pieces 14 may be made in differentiating sizes and configurations to suit specialized pieces such as a forward, halfback, defender or goalie or to represent well known teams or players. The configuration of the magnetic base 18 of the game piece 14 is shown with the magnet 62 secured to the base 64 of the game piece 14 with an adhesive 34 although any other suitable application may be employed.

Figure 9:
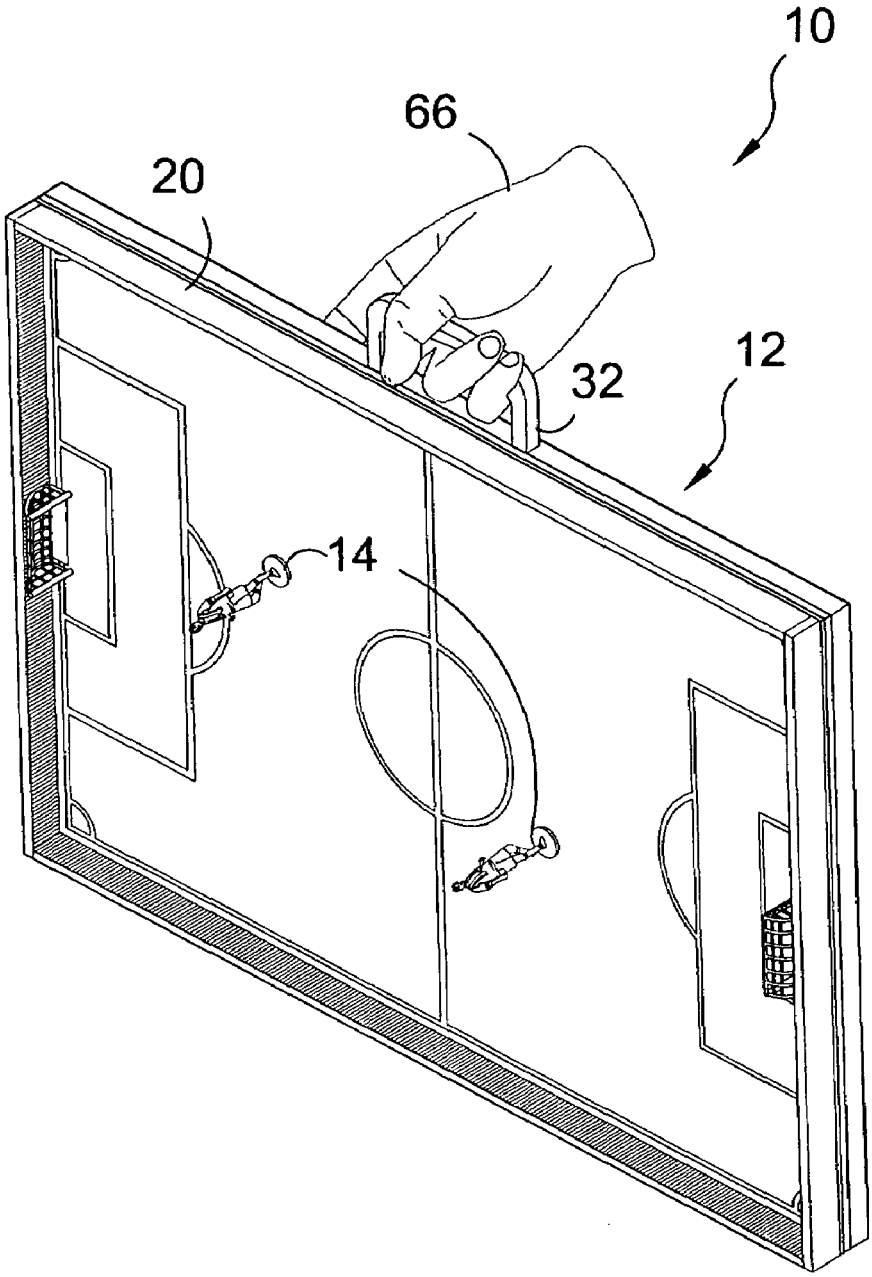
FIG. 9 is an illustrative view of the game board of the present invention.

FIG. 9 is an illustrative view of the game board 12 of the present invention 10. The present invention 10 provides confining walls 20 around the peripheries of the game board 12, one having a handle 32 fixedly attached thereto, allowing the user 66 to easily move the game from one place to another without interrupting the game in progress as the game pieces 14 remain in place due to their magnetic properties and the underlying stainless steel plate.

Figure 10:
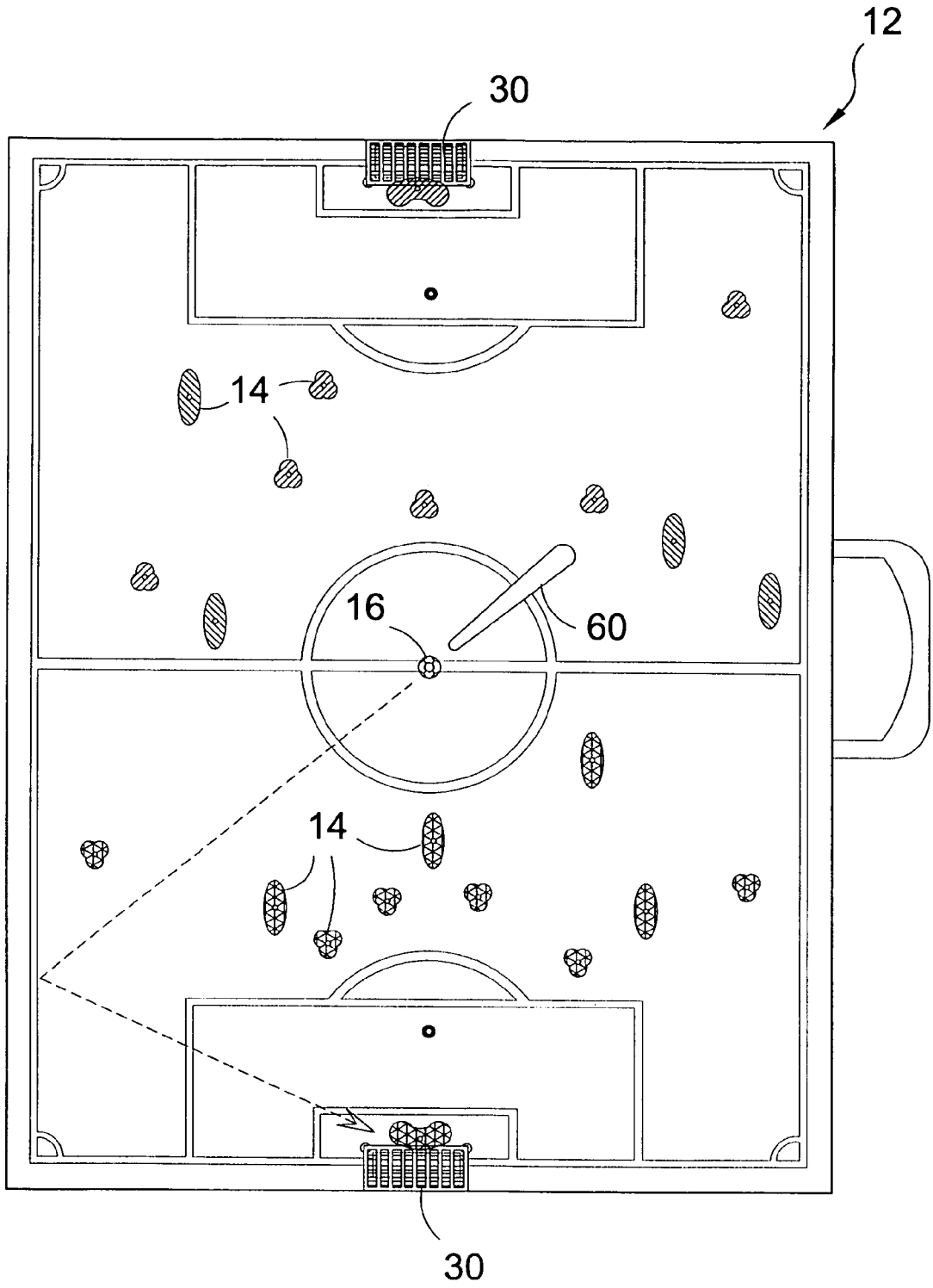
FIG. 10 is a top view of the game board in play.

FIG. 10 is a top view of the game board 12 in play. A plurality of game pieces 14 are repositionable to a desired location during a turn of play with means for propelling a game ball 16 by a stick 60 to score a goal 30. Magnetic means are provided for retaining positioning of placed game pieces 14 when impacted by the game ball 16 during play and means for confining the game ball 16 to the game board during play whereby each player in turn attempts to score a goal 30 using the at rest position of the game ball 16 from the previous player's turn as their starting point.

Figure 11:
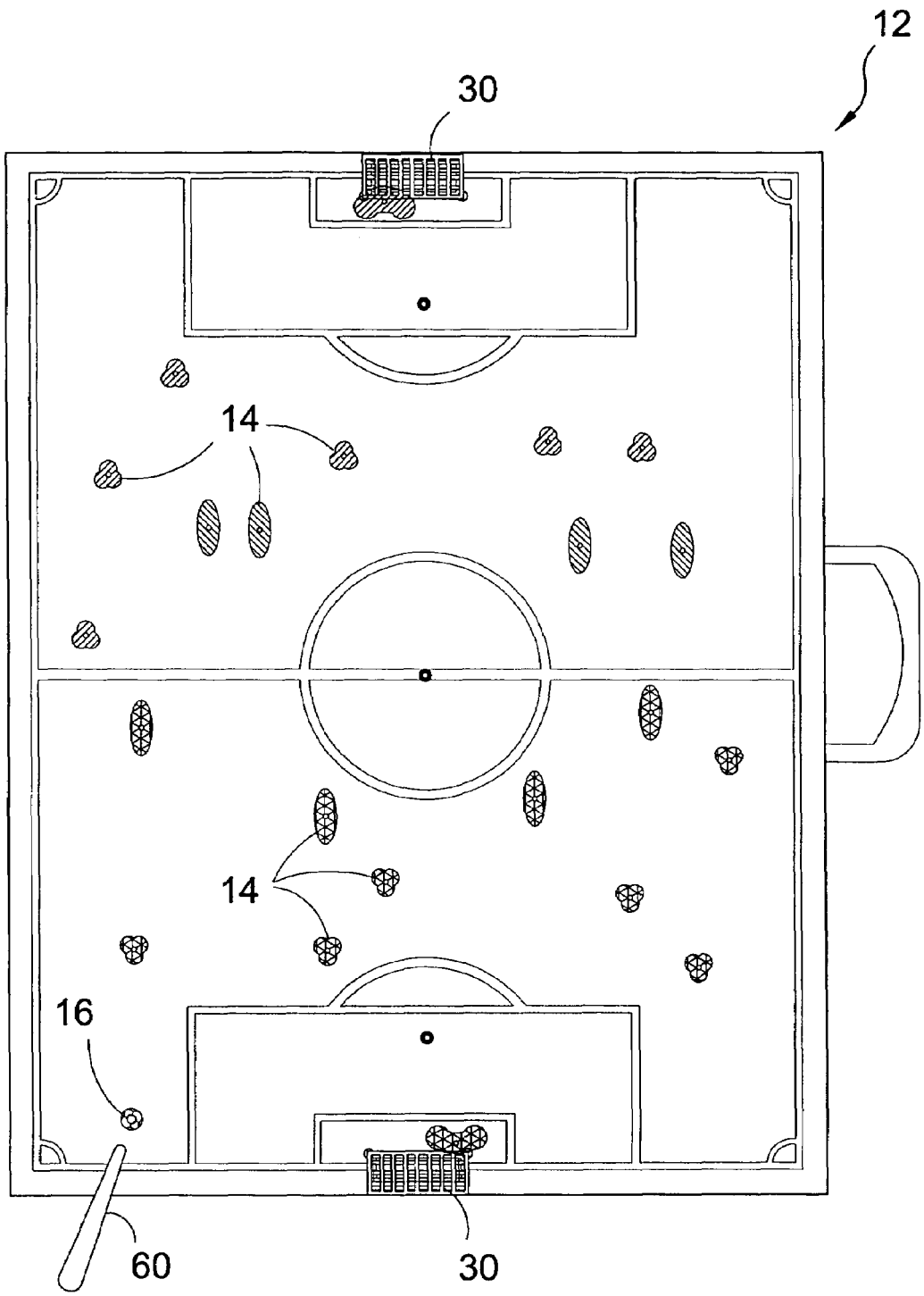
FIG. 11 is a continued top view of the game board in play.

FIG. 11 is a continued top view of the game board 12 in play. A plurality of game pieces 14 are repositionable to a desired location during a turn of play with means for propelling a game ball 16 by a stick 60 to score a goal 30. Magnetic means are provided for retaining positioning of placed game pieces 14 when impacted by the game ball 16 during play and means for confining the game ball 16 to the game board during play whereby each player in turn attempts to score a goal 30 using the at rest position of the game ball 16 from the previous player's turn as their starting point.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is:

1. A strategy board game consisting of:

a) a game board comprising a base plate, a ferromagnetic metallic sheet secured to said base plate, and a felt fabric sheet covering the metallic sheet forming a playing surface, said felt fabric sheet having markings defining a soccer playing field impregnated thereon including a centrally positioned gameball spot and a pair of penalty spots with one penalty spot disposed proximal the front of each said goal;

b) a plurality of game pieces on said playing surface, said game pieces having magnetic bases that enable a user to quickly and easily reposition and secure each said game piece on said playing surface;

c) a ball;

d) a stick for striking said ball;

e) a pair of goals disposed on opposing ends of said playing surface, said goals having magnetic elements in bases thereof thereby rendering said goals removable and repositionable while resistant to displacement when on said game board during game play to prevent displacement during play; and f) rules for governing game play wherein the object of the game is for two opponents to alternately strike said ball with said stick, reposition said game pieces after each strike and get said ball into said goal to score a point.

2. A strategy board game as recited in claim 1, wherein said game board has means for confining said ball within the field of play during game play.

3. A strategy board game as recited in claim 2, wherein said base plate and said fabric sheet are secured to said metallic sheet with adhesive.

4. A strategy board game as recited in claim 3, wherein said metallic sheet is fabricated of stainless steel.

5. A strategy board game as recited in claim 4, wherein said base plate is fabricated of wood.

6. A strategy board game as recited in claim 4, wherein said confining means for said ball is a plurality of confining walls disposed peripherally on said game board and projecting perpendicularly upward therefrom.

7. A strategy board game as recited in claim 6, further including a handle member disposed on the outer side of one said confining wall.

8. A strategy board game as recited in claim 7, wherein said handle member is secured to said confining wall with screws.

9. A strategy board game as recited in claim 8, wherein said game pieces are shaped to represent two teams of soccer players with each said team distinctly recognizable from the other.

10. A strategy board game as recited in claim 9, wherein said striker stick is elongate and tapered.

11. A strategy board game as recited in claim 2, wherein said base plate is fabricated of a sturdy plastic.

* * * * *